US007559811B1

(12) United States Patent
Polnyi

(10) Patent No.: US 7,559,811 B1
(45) Date of Patent: Jul. 14, 2009

(54) TERMINAL WITH REDUCED CONTACT TIP

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/286,696

(22) Filed: Sep. 30, 2008

(51) Int. Cl.
*H01R 4/48* (2006.01)

(52) U.S. Cl. ..... 439/862; 439/66; 439/591

(58) Field of Classification Search ..... 439/66, 439/591, 630, 636, 637, 862
See application file for complete search history.

(56) References Cited

U.S. PATENT DOCUMENTS 3,199,066 A * 8/1965 Eledge et al. ..... 439/857
5,139,446 A * 8/1992 Costello et al. ..... 439/751
6,315,621 B1 * 11/2001 Natori et al. ..... 439/862
6,685,512 B2 * 2/2004 Ooya ..... 439/630
6,881,070 B2 4/2005 Chiang
6,905,371 B2 * 6/2005 Yi-Tse ..... 439/660
6,997,751 B2 * 2/2006 Miyamoto ..... 439/630
7,052,284 B2 * 5/2006 Liao et al. ..... 439/66
7,402,049 B2 * 7/2008 Polnyi ..... 439/66
2009/0035995 A1 * 2/2009 Chang et al. ..... 439/630

* cited by examiner

*Primary Examiner*—James Harvey
(74) *Attorney, Agent, or Firm*—Wei Te Chung

(57) ABSTRACT

A terminal, adapted for electrically connecting an IC package and a printed circuit board, comprises: a base, a first elastic arm and a second elastic arm. The first elastic arm and the second elastic arm laterally and upwardly extend from a top and a bottom of the base, respectively. Each of the elastic arms has a contact tip on a free end thereof, and each of the two contact tips defines a gap to divide the contact tip into two contacting segments. After the terminal is punched from a metal piece, the gap is inwardly pressed on two sides thereof to have a narrow part between the contacting segments, so a width of the contact tip is reduce.

12 Claims, 4 Drawing Sheets

TERMINAL WITH REDUCED CONTACT TIP

BACKGROUND OF THE INVENTION

1. Field of the Invention

The present invention relates to a terminal of a socket which is mounted to a printed circuit board and adapted for electrically connecting a semiconductor package, especially to a land grid array (LGA) contact.

2. Description of the Related Art

LGA (Land Grid Array) is one of most common package for IC (Integrated circuit) or wafer. A LGA connector provides a solderless interconnection with a PCB (Printed Circuit Board). Such an electronic connector adapted to a LGA package generally comprises an insulative housing, wherein has a plurality of passageways, in which a plurality terminals are mounted respectively. Each terminal has a pair of electronic contact portions for electrically connecting with a CPU (Central Processing Central) and a PCB respectively. And, both of a bottom surface of the CPU and an upper surface of the PCB are respectively provided a plurality of pads to implement electronic interconnection with the electronic contacts of the terminal without solder.

A terminal for such LGA connectors defines a gap in the electronic contact portion to divide the electronic contact portion into two contact segments which both contact with a same pad of the CPU or the PCB to improve an electronic connecting between the LGA connector with the CPU or the PCB. However, since the pads of present CPU are arranged in much high density to transmit much more signals and lessen itself size, and small pitches between terminals become a vital requirement for LGA connector, so the gap in the contact portion of the terminal should be narrower to reduce a width of the electronic contact portion. However, such gap is usually formed by punching, so limited by manufacture equipment, it is difficult to cut out a small gap.

Hence, an improved terminal is required to overcome the disadvantages of the prior art.

SUMMARY OF THE INVENTION

An object of the invention is to provide a terminal adapted for being arranged in high density.

To achieve the above-mentioned object, a terminal, adapted for electrically connecting an IC package and a printed circuit board, comprises: a base; a first elastic arm laterally and upwardly extending from a top of the base and having a first contact tip for the IC package; a second elastic arm laterally and downwardly extending from a bottom of the base and having a second contact tip for the printed circuit board; where in at least one of the two contact tips defines a gap to divide the contact tip into two contacting segments, and the gap has a wider part near the base and a narrow part between the contacting segments.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
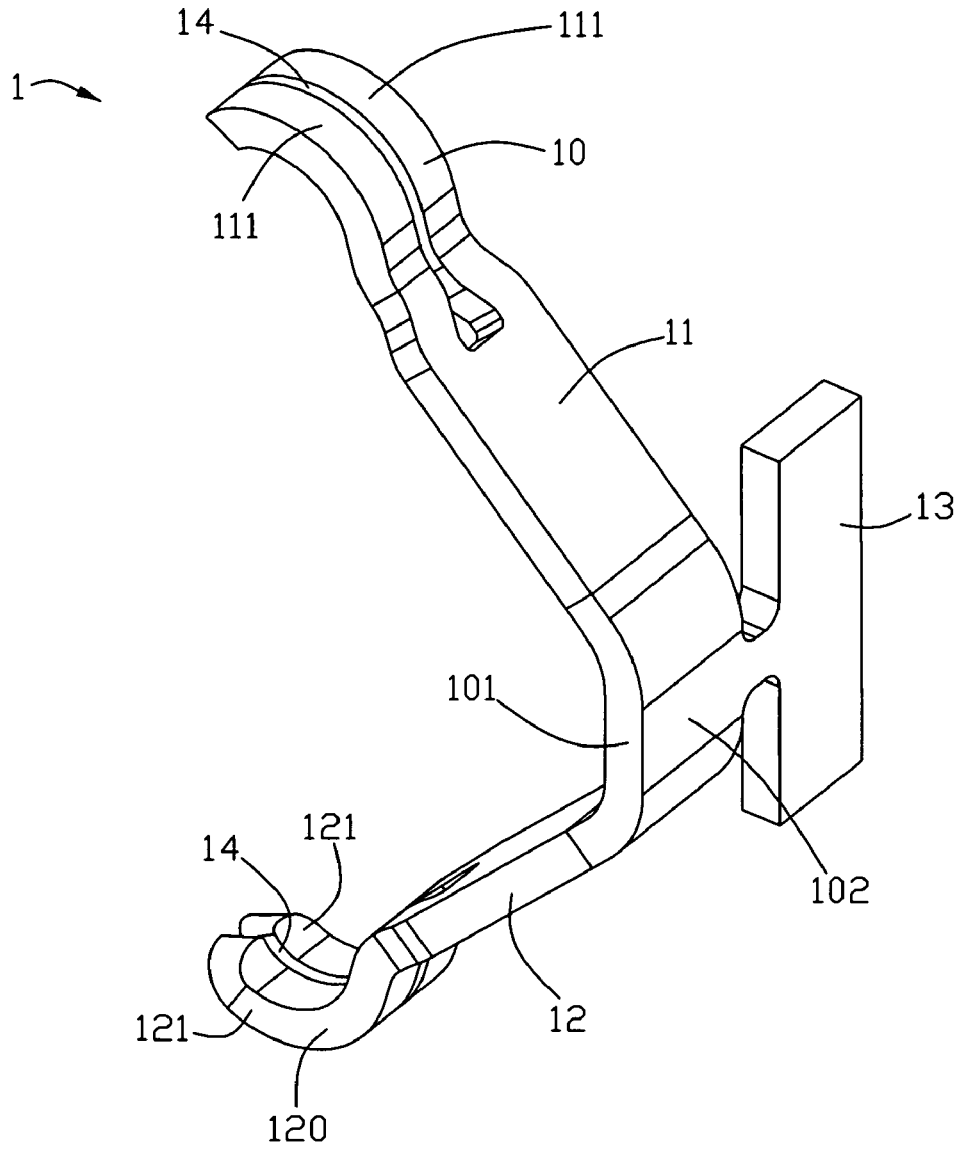
FIG. 1 is a perspective view of a terminal in accordance with a first preferred embodiment of present invention.
Figure 2:
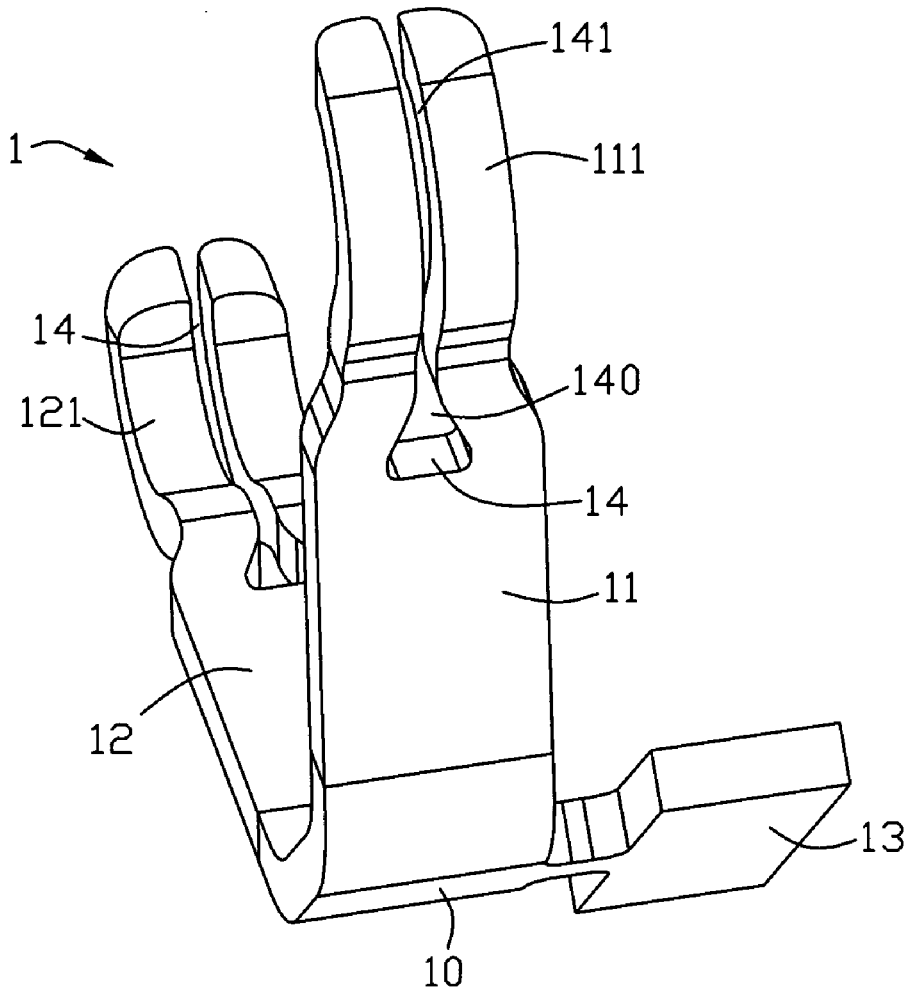
FIG. 2 is an another perspective view of the terminal in FIG. 1.

Referring to FIGS. 1-2, a terminal 1 in accordance with a first preferred embodiment of present invention is disclosed. The terminal 1 is adapted for electrically connecting an IC package (not shown) and a printed circuit board (not shown) by LGA (Land Grid Array) to LGA interface. The terminal 1 comprises a base 10, a first elastic arm 11, a second elastic arm 12 and a retaining portion 13. The base 10 includes a front side 101 and a rear side 102. The first elastic arm 11 laterally and upwardly extends from a top of the base 10. The second elastic arm 12 laterally and downwardly extends from a bottom of the base 10. And a laterally extending direction of the first elastic arm 11 is same with that of the second elastic arm 12, and the first elastic arm 11 and the second elastic arm 12 are face to each other. The retaining portion 13 is rectangle board-like shape and links with the rear side 102 of the base 10. The retaining portion 13 engages with an inner sidewall of a housing (not shown) to dispose the terminal 1 in the housing (not shown) to form a socket (not shown).

The first elastic arm 11 defines an arc first contact tip 110 upwardly extending from a top end thereof for contacting with the IC package (not shown), and the second elastic arm 12 defines an arc second contact tip 120 downwardly extending from a bottom end thereof for contacting with the printed circuit board (not shown). The terminal 1 further defines two gaps 14 laterally passing through the first and the second contacting tips 110, 120 and continuatively through parts of the terminal 1 near the first and the second contacting tips 110, 120, respectively. The gaps 14 divide the first contact tips 110 into two contacting segments 111 and the second contact tips 120 into two contacting segments 121.

What should be noted is that the gaps 14 are not directly formed by punching. After punching the terminal 1 from a metal piece, the gap 14 has an original configure with an equal or unequal width, but at least a smallest width of the gap 14 is large enough for a punching equipment, so that the terminal 1 can be easily manufactured, then inwardly press two sides of each gap 14 to narrow the gap 14 and make the gap 14 has a wider part 140 near the base 10 and a narrow part 141 through a free end of the terminal 1, finally bend corresponding parts of the terminal 1 to form the ultimate product. The terminal 1 is pressed on approximately whole side of gap 14, and the narrow part 141 of the gap 14 approximately through the whole contacting tip 110/120, so a width of the first and the second contact tips 110, 120 are reduced, and that is benefit for arranging the terminals 1 in much higher density.

Figure 3:
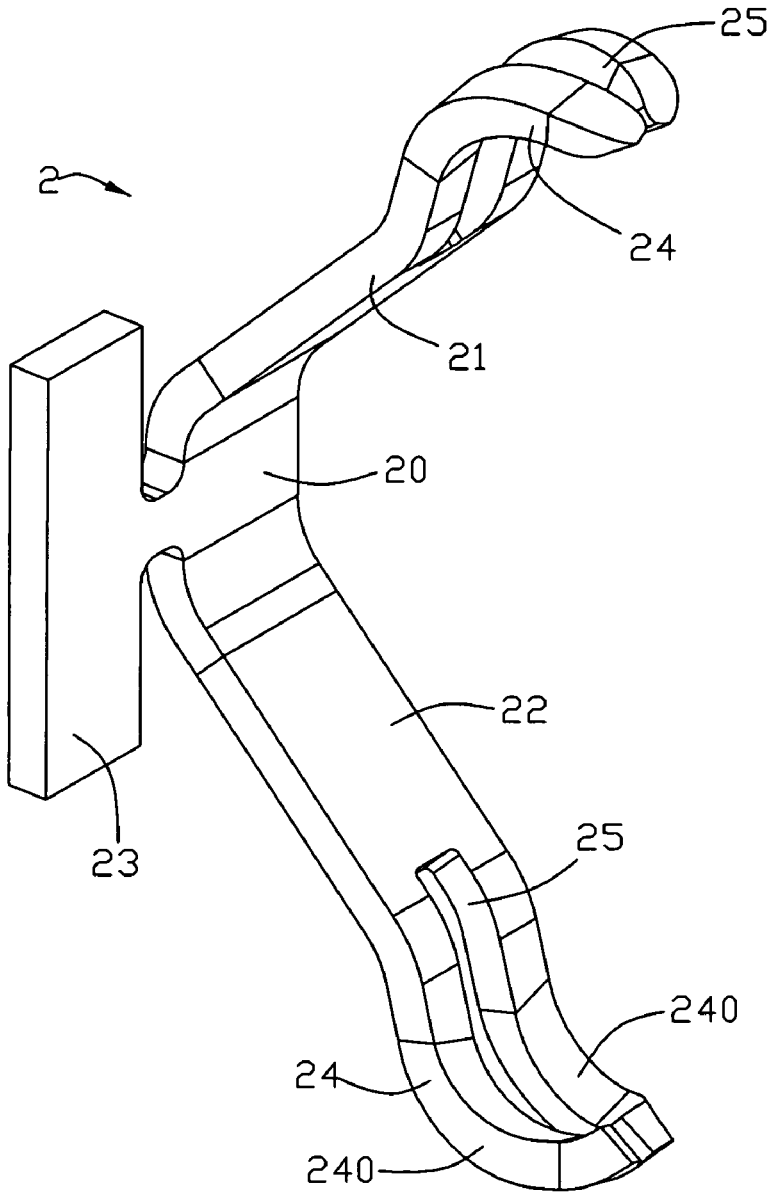
FIG. 3 is a perspective view of a terminal in accordance with a second preferred embodiment of present invention.
Figure 4:
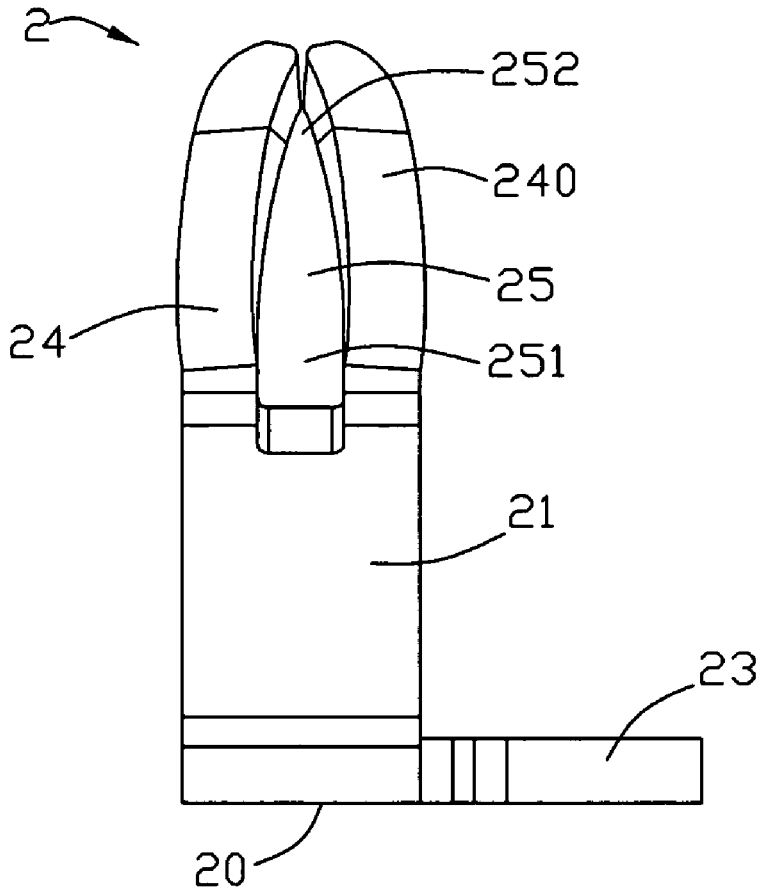
FIG. 4 is a top view of the terminal in FIG. 3.

Referring to FIG. 3 and FIG. 4, in accordance with a second embodiment preferred embodiment of present invention is disclosed, another terminal 2 is disclosed. A configure of the terminal 2 is substantially same as that of the terminal 1 in the first embodiment, the terminal 2 comprises a base 20, a first elastic arm 21 upwardly extending from the base 20, a second elastic arm 22 downwardly extending from the base 20 and a retaining portion 23. And both of the first and the second elastic arms 21, 22 have a contacting tip 24 and a gap 25 dividing the contacting tip 24 into two contacting segments 240. The gap 25 also has a wider part 250 near the base 20 and a narrow part 251 near a free end of the terminal 2.

After punching the terminal 2 from a metal piece, the gap 25 has an original configure with an equal or unequal width, but at least a smallest width of the gap 25 is large enough for a punching equipment, so that the terminal 1 can be easily manufactured. Then curve the free ends of the contacting segments 240 downwardly and toward each other to have an angle to the corresponding contact segment 240, so the free ends of the contacting segments 240 close to each other by above curving, and the narrow part 251 is defined on the free end of the terminal 2, which also can reduce a width of the contact tips 24, and that is benefit for arranging the terminals 2 in much higher density.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A terminal, adapted for electrically connecting an IC package and a printed circuit board, comprising:

a base;

a first elastic arm laterally and upwardly extending from a top of the base and having a first contact tip for connecting with the IC package;

a second elastic arm laterally and downwardly extending from a bottom of the base and having a second contact tip for connecting with the printed circuit board;

where in at least one of the two contact tips defines a gap to divide the contact tip into two contacting segments, and the gap has a wider part near the base and a narrow part between the contacting segments.

2. The terminal as described in claim 1, wherein each of the two contact tips has the gap and the two contacting segments.

3. The terminal as described in claim 2, wherein the narrow part of the gap approximately through the whole contacting tip and has two parallel edges.

4. The terminal as described in claim 2, wherein the narrow part of the gap is disposed between the tip of the contact tip, and two edges of the narrow part of the gap are aslant to each other.

5. The terminal as described in claim 3, wherein the gap has an original configure with an large enough width for punching equipment after the terminal is punched from a metal piece.

6. The terminal as described in claim 5, wherein two sides of the gap are pressed to narrow the width of the gap so as to reduce a width of the contact tip.

7. The terminal as described in claim 2, further comprising a retaining portion links with the base.

8. The terminal as described in claim 4, wherein the gap has an original configure with an large enough width for punching equipment after the terminal is punched from a metal piece.

9. A terminal, adapted for electrically connecting an IC package and a printed circuit board, comprising:

a base;

a first elastic arm laterally and upwardly extending from a top of the base for contacting with the IC package;

a second elastic arm laterally and downwardly extending from a bottom of the base for contacting with the printed circuit board;

where in at least one of the two elastic arms defines a gap extending along a same extending direction of corresponding elastic arm and having a wider part near the base and a narrow part near a free end of the terminal, a width of a part of the elastic arm between which the narrow part of the gap is disposed is smaller than that of another part of the elastic arm between which the wider part of the gap is disposed.

10. The terminal as described in claim 9, wherein each of the two contact tips has the gap.

11. The terminal as described in claim 10, wherein the gap has an original configure with an large enough width for punching equipment after the terminal is punched from a metal piece.

12. The terminal as described in claim 11, wherein two sides of the gap are pressed to narrow the width of the gap so as to reduce a width of a tip of the terminal.

* * * * *